United States Patent [19]

Emrich et al.

[11] Patent Number: 4,711,173

[45] Date of Patent: Dec. 8, 1987

[54] CHANGING DRIVE FOR THE DISTRIBUTING ROLLERS OF AT LEAST ONE INKING UNIT OF A PRINTING UNIT OF AN OFFSET ROTARY PRESS

[75] Inventors: Helmut Emrich, Offenbach am Main; Josef Mathes, Offenbach; Heinrich Ochs, Sinntal-Oberzell; Janko Despot, Offenbach am Main, all of Fed. Rep. of Germany

[73] Assignee: M.A.N.- Roland Druckmaschinen Aktiengesellschaft, Fed. Rep. of Germany

[21] Appl. No.: 823,345

[22] Filed: Jan. 28, 1986

[30] Foreign Application Priority Data

Jan. 29, 1985 [DE] Fed. Rep. of Germany ..... 3502863

[51] Int. Cl.[4] ..... B41F 31/14

[52] U.S. Cl. ..... 101/349; 101/DIG. 14

[58] Field of Search ..... 101/DIG. 14, 348, 349, 101/350, 148, 207–210

[56] References Cited

U.S. PATENT DOCUMENTS 982,263 1/1911 Flett ..... 101/178

2,944,482 7/1960 Aller ..... 101/177

3,994,222 11/1976 Pullen ..... 101/DIG. 14

4,513,663 4/1985 Hummel et al. ..... 101/348

*Primary Examiner*—J. Reed Fisher

[57] ABSTRACT

The amount of travel and the phase of axial reciprocation for sets of distributing rollers provided on each of at least two inking units of a rotary printing unit are independently adjustable from a central location. For each of the inking units, one eccentric drive adjustable in reciprocating phase and in the stroke or amount of travel is connected to the end portion of an impression cylinder twice the size of associated plate cylinders so that the axial reciprocating movements of the distributing rollers are derived in synchronism with the rotation of the impression cylinder and in a ratio of 1:2 to the rotation of the associated plate cylinders. In one embodiment, a single bolt clamps the two eccentric drives one on top of the other to the end portion of the impression cylinder. In another embodiment, the two eccentrics drives are concentrically arranged in ring-fashion to permit separate clamping and unclamping of each of the four independent adjustments of the amount of travel and phase of reciprocation.

5 Claims, 4 Drawing Figures

CHANGING DRIVE FOR THE DISTRIBUTING ROLLERS OF AT LEAST ONE INKING UNIT OF A PRINTING UNIT OF AN OFFSET ROTARY PRESS

BACKGROUND OF THE INVENTION

1. Field of the Invention

The invention relates to an adjustable drive for axially reciprocating the distributing rollers of at least one inking unit of a printing unit of a rotary printing press, the drive being adjustable to change the amount of axial travel of the distributing rollers.

2. Description of the Related Art

In offset printing presses, it has proven desirable to axially reciprocate the ink distributing rollers in order to more uniformly transfer ink to the ink applicator rollers.

A drive for axially reciprocating the ink distributing rollers is disclosed in U.S. Pat. No. 1,741,414. A disadvantage with that mechanism is that the distributing rollers are driven by an elaborate separate drive for the adjustable axial reciprocation and it is impossible to adjust the phase of the axial reciprocation with respect to the phase of rotation of the plate cylinder. Another elaborate drive of this kind which further permits adjustment when the press is running is disclosed in U.S. Pat. No. 4,513,662.

European Patent No. 66,114 discloses a drive wherein a common eccentric drive whose reciprocating throw is adjustable is provided for two inking units of a four-cylinder printing unit and is disposed on a drive shaft whose movement is derived from an inking unit drive. A disadvantage with that mechanism is that the nature of the coupling makes it impossible to have a separate central adjustment of the axial reciprocation of the ink distributing rollers in the inking units. Difficulties therefore arise, more particularly when in addition to separate central adjustment of the extent or throw of the reciprocation, an adjustment of the phase of the reciprocating movement is also required in order to be able to set up such comparability of the ink surfaces or ink films to be distributed as will satisfy the separate requirements in the two inking units. Another disadvantage is that the common eccentric drive requires a reduction transmission having a driving gear which must be driven by the machine by way of a clutched gear.

SUMMARY OF THE INVENTION

The primary object of the present invention to provide a centrally-disposed adjustable drive for axially reciprocating the ink distributing rollers in a rotary printing press in which the axial reciprocations of sets of distributing rollers provided one each for of at least two inking units of a printing unit can be derived in common from an available machine shaft but which are adjustable separately, and preferably independently in each case, to select the amount of axial travel and the phase of the axial reciprocation.

By employing the present invention, a drive for adjusting both the amount of axial travel and phase of the axial reciprocation of the ink distributing rollers is disposed directly on the shaft of the impression cylinder of a five-cylinder arrangement so that no reduction transmission is required to provide a 1:2 step-down in the number of throws in the axial reciprocation for at least two inking units of a printing unit, thus simplifying drive conditions. Also, the association of an individual eccentric drive with each set of distributing rollers makes it possible to have separate and preferably independent adjustment of the amount of axial travel and of the phase of the axial reciprocation, so that the ink layers or ink films can be adapted satisfactorily to the separate requirements of at least two inking units. Placing the adjustable drive in a central position saves space and facilitates adjustment of the press.

BRIEF DESCRIPTION OF THE DRAWINGS

Other objects and advantages of the invention will become apparent upon reading the following detailed description and upon reference to the drawings, in which.

Figure 1:
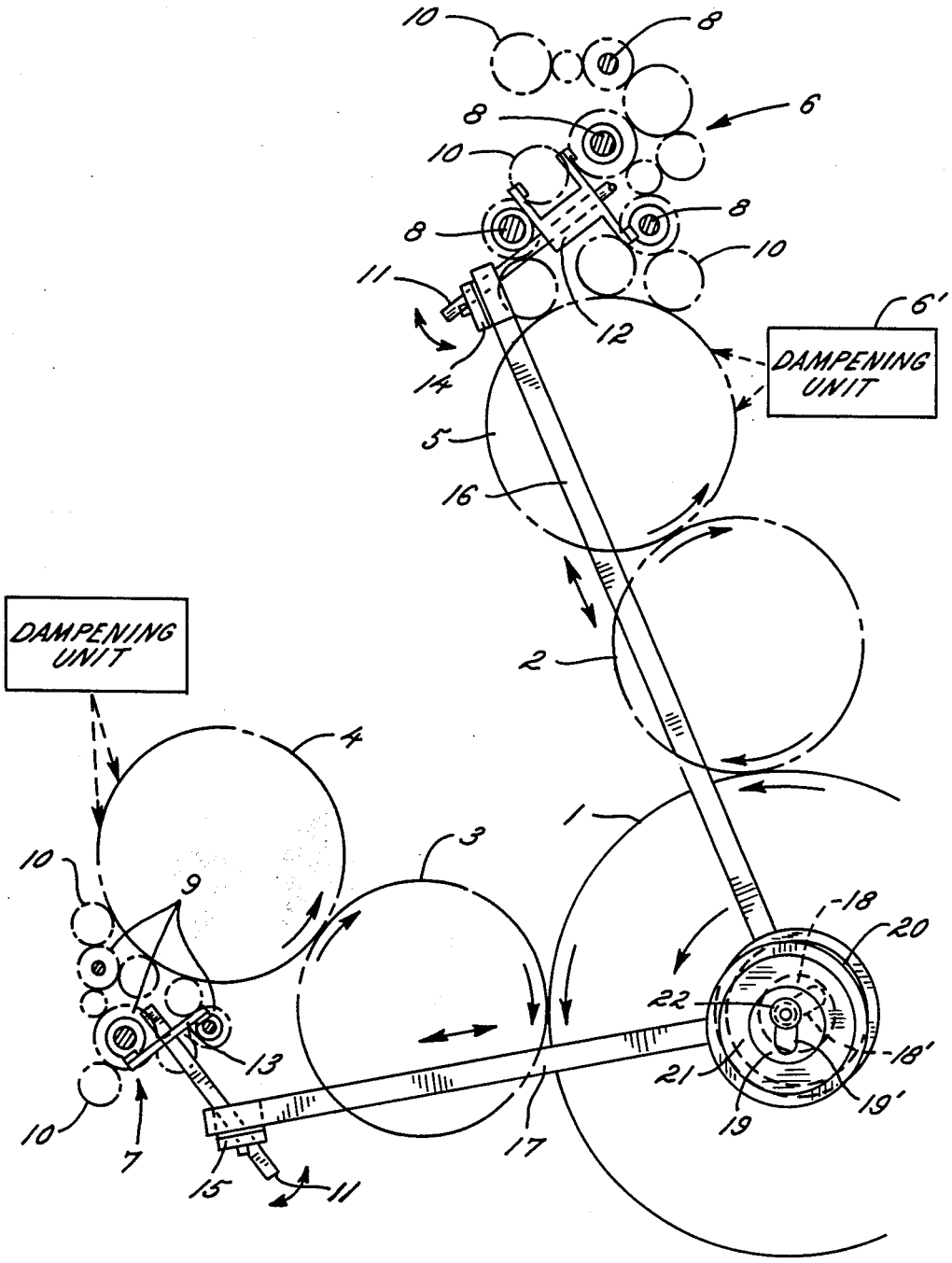
FIG. 1 is a side view of the adjustable drive for axially reciprocating the ink distributor rollers a five-cylinder printing unit having two inking units and a double-sized impression cylinder.

While the invention is susceptible to various modifications and alternative forms, specific embodiments thereof have been shown by way of examples in the drawings and will herein be described in detail. It should be understood, however, that it is not intended to limit the invention to the particular forms disclosed, but on the contrary, the intention is to cover all modifications, equivalents, and alternatives falling within the scope of the invention defined by the appended claims.

DETAILED DESCRIPTION OF THE PREFERRED EMBODIMENTS

Turning now to the drawings, FIG. 1 shows a five-cylinder printing unit rotating two blanket cylinders 2, 3, two plate cylinders 4, 5 and an impression cylinder 1 which is twice as large as the blanket and plate cylinders 2–5. An inking unit 6, 7 and a damping unit 6', 7' is associated with each plate cylinder 4, 5.

In accordance with an important aspect of the present invention, an eccentric drive 18, 20 is provided for the inking unit 6 and an eccentric drive 19, 21 is provided for the inking unit 7, both drives being separately adjustable to select the amount of travel and the phase of reciprocation, and being centrally located and connected to the end of the impression cylinder 1.

Figure 2:
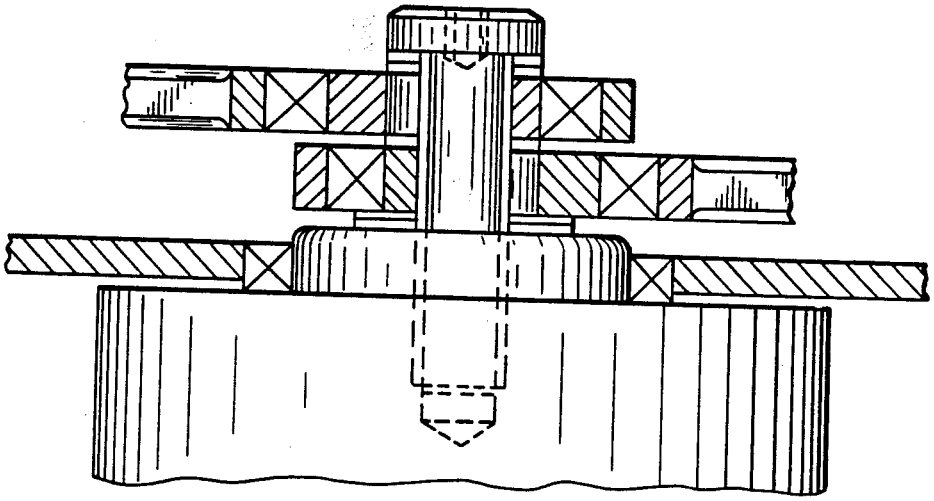
FIG. 2 is a view in cross-section of the central portion of the adjustable drive of FIG. 1.

As FIGS. 1 and 2 together show, the eccentric drives for the inking units 6, 7 have a respective disc 18, 19 each formed with a slot 18', 19' connected by way of a bolt 22 for radial movement and for rotation in the peripheral direction with respect to the end of the cylinder 1. By way of annular bearings 20, 21, oscillating levers 16, 17, control levers 14, 15 and rockers 12, 13, axial reciprocations of the distributing rollers 8, 9 are derived from the rotation of the impression cylinder 1 and at half the speed of rotation of the associated plate cylinder 4, 5. The rockers 12, 13 are mounted by way of bearing pins 11 to the side frame 40 of the printing press. The rockers 12, 13 are of conventional construction and schematically represent a number of rockers sufficient to axially reciprocate a number of the ink distributing rollers 8, 9 in the inking units 6, 7. The construction of the rockers in such an inking unit is shown and described in Hummel et al., U.S. Pat. No. 4,513,663 issued Apr. 30, 1985, herein incorporated by reference.

To adjust the amount of axial throw or travel and the phase of the axial reciprocation of each set of ink distributing rollers 8, 9, the bolt 22 must be loosened or disassembled from the impression cylinder 1 in order that the respective radial and angular positions of the respective discs 18, 19 may be readjusted with respect to the impression cylinder. The deviation of the center of each disc 18, 19 from the central axis of the impression cylinder determines the respective amount of axial throw or travel of the respective ink distributing rollers and is therefore set by manually positioning the respective disc to position the bolt 22 within the respective slot 18', 19'. Since the angular position of each disc 18, 19 with respect to the impression cylinder 1 determines the phase of axial reciprocation of the respective set of ink distributing rollers, the phase is set by manually rotating each disc about the bolt 22. Once the required angular and radial positions of discs 18, 19 are set, the bolt 22 is tightened to securely clamp the discs 18, 19 to the impression cylinder.

Although the embodiment of the invention shown in FIGS. 1 and 2 is easy to fabricate, the single bolt 22 is used as a clamping means to fix the four independent adjustments of axial travel and phase. Readjustment of only the phase of reciprocation of the first set of ink distributor rollers 8, however, requires removal of the second disc 19 in order to gain access to the first disc 18, so that some skill must be exercised to maintain the other adjustments in this situation.

Figure 3:
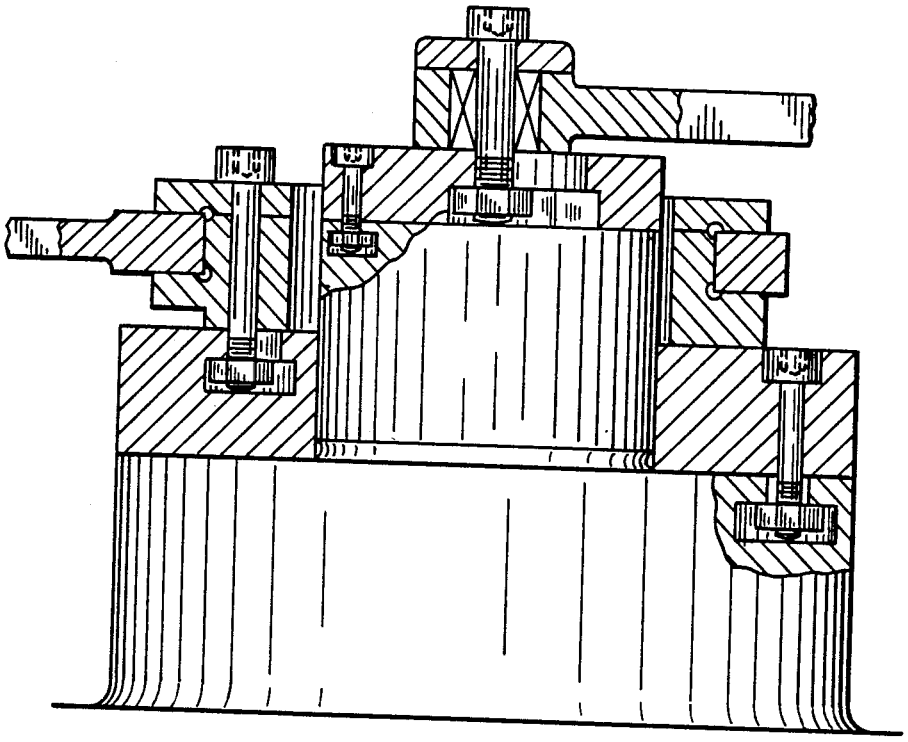
FIG. 3 is a view in cross-section of the central portion of an alternative embodiment of the invention.
Figure 4:
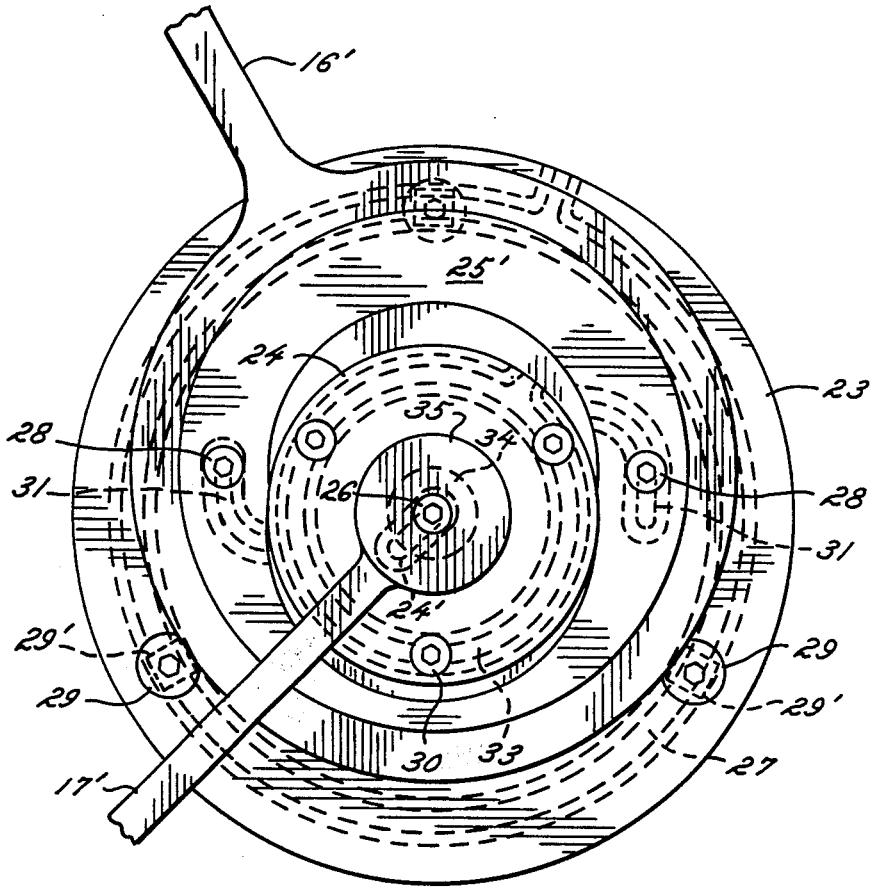
FIG. 4 is a side view corresponding to FIG. 3.

Turning now to FIGS. 3 and 4, there are shown views of a second embodiment of the invention which employs four separate clamping means to independently fix the four adjustments of the amount of travel and the phase of reciprocation of the two sets of ink distributing rollers 8, 9. So that the clamping means are freely accessible, an eccentric drive 23, 25 for the inking unit 6 is disposed concentrically in ring-fashion above a second eccentric drive 24, 26 of the inking unit 7 and both the drives are connected to the end of the impression cylinder now designated 1'. For adjusting the phase of axial reciprocation of the ink distributing rollers 8 in the inking unit 6, a disc 23 is rotatably mounted to the impression cylinder 1' and is secured by bolts 29 engaging nuts 29' disposed in circumferential T-grooves 27 milled into the end portion of the impression cylinder 1'. Also, for adjusting the amount of travel of the ink distributing rollers 8 in the inking unit 6, the disc 23 receives in T-grooves 31 a disc 25 mounted for radial movement and secured by bolts 28 engaging nuts 28'. The oscillating lever now designated 16' for the inking unit 6 is mounted on a bearing surface 32 of the disc 25 and is held in place by a retaining disc 25' also clamped by the bolts 28. The eccentric drive 24, 26 of the inking unit 7 has a disc 24 formed with a slot 24' of a T-groove. For adjusting the phase of reciprocation of the ink distributing rollers 9 in the inking unit 7, the disc 24 is rotatably mounted to the end portion of the impression cylinder 1' and is secured by bolts 30 engaging nuts 30' disposed in circumferential T-grooves 33. Also, for adjusting the amount of travel of the ink distributing rollers 9 in the inking unit 7, a bolt 26 extends through the slot 24' to engage a nut 26'. The oscillating lever now designated 17' for the inking unit 7 is received on the bolt 26 with the interposition of pivot bearings 34 which are retained by a retaining disc 35.

Therefore, a selected one of the four independent adjustments of the amount of travel and phase of axial reciprocation of the ink distributing rollers can be made without distributing the other adjustments by loosening only the appropriate set of bolts, effecting the required circumferential or radial shift, and retightening the set of bolts.

Further variations of the construction shown in FIGS. 3–4 will become apparent to a person of ordinary skill in the art. Instead of using the circumferential T-grooves 27, 33 milled into the end portion of the impression cylinder 1', for example, the discs 23 and 24 could be rotatably mounted and secured to the impression cylinder by annular clamping rings fitted about the periphery of the discs 23 and 24 and fastened by screws to the end portion of the impression cylinder.

What is claimed is:

1. In a rotary printing press including an impression cylinder having an end portion, two plate cylinders associated with the impression cylinder, and respective inking units associated with the plate cylinders, each inking unit having a respective set of ink distributing rollers, a mechanism for axially reciprocating said ink distributing rollers, said impression cylinder having twice the diameter of the associated plate cylinders, so that the axial reciprocation of the sets of ink distributing rollers is derived in synchronism with the rotation of the impression cylinder and in a ratio of 1:2 to the rotation of the associated plate cylinders, said reciprocating mechanism generating reciprocating motions transmitted by coupling elements to the ink distributing rollers, wherein the improvement comprises, first and second rotating eccentric drives for axially reciprocating the respective sets of ink distributing rollers, each of said rotating eccentric drives being adjustable in the amount of travel and the phase of the reciprocation and being connected to the end portion of the impression cylinder, said first rotating eccentric drive including a first drive disk fastened concentrically on the end portion of the impression cylinder and adjustable in the circumferential direction and a first eccentric disk fastened to said first drive disk and adjustable in the radial direction, said first eccentric disk having mounted thereon a first swing bearing that carries a first oscillating lever for a first one of said inking units, and said second rotating eccentric drive including a second drive disk fastened concentrically on the end portion of the impression cylinder and adjustable in the circumferential direction and a second swing bearing that carries a second oscillating lever fastened to said second drive disk and adjustable in the radial direction for a second one of said inking units.

2. The mechanism as claimed in claim 1, wherein said first and second rotating eccentric drives are mounted to the end portion of the impression cylinder independently of one another, said first drive disk being disposed concentrically in ring-fashion with respect to said second drive disk.

3. The mechanism as claimed in claim 2, wherein said rotating eccentric drive disks each have a central elongated slot through which said bolt extends to clamp the eccentric disks one over the other to the end portion of the impression cylinder.

4. The mechanism as claimed in claim 1, wherein said printing press comprises a five-cylinder offset printing unit including two blanket cylinders cooperating with the impression cylinder and respective ones of the plate cylinders.

5. In a rotary printing press including an impression cylinder having an end portion, two plate cylinders associated with the impression cylinder, and respective inking units associated with the plate cylinders, each inking unit having a respective set of ink distributing rollers, a mechanism for axially reciprocating said ink distributing rollers, said impression cylinder having twice the diameter of the associated plate cylinders, so that the axial reciprocation of the sets of ink distributing rollers is derived in synchronism with the rotation of the impression cylinder and in a ratio of 1:2 to the rotation of the associated plate cylinders, said reciprocating mechanism generating reciprocating motions transmitted by coupling elements to the ink distributing rollers, wherein the improvement comprises, first and second rotating eccentric drives for axially reciprocating the respective sets of ink distributing rollers, each of said rotating eccentric drives being adjustable in the amount of travel and the phase of the reciprocation and being connected to the end portion of the impression cylinder, said first rotating eccentric drive including a first eccentric disk provided on the end portion of the impression cylinder and adjustable in the circumferential direction and in the radial direction, said first eccentric disk having mounted thereon a first swing bearing that carries a first oscillating lever for a first inking unit, and said second eccentric drive includes a second eccentric disk provided on the end portion of the impression cylinder and adjustable in the circumferential direction and in the radial direction, said second eccentric disk having mounted thereon a second swing bearing that carries a second oscillating lever for a second inking unit, and a bolt is screwable concentrically in the end portion of the impression cylinder and clamps both eccentric disks lying adjacently to one another against the end portion of the impression cylinder.

* * * * *